US010992039B2

(12) United States Patent
Yokokawa et al.

(10) Patent No.: US 10,992,039 B2
(45) Date of Patent: Apr. 27, 2021

(54) ARRAY ANTENNA DEVICE

(71) Applicant: Mitsubishi Electric Corporation, Tokyo (JP)

(72) Inventors: Kei Yokokawa, Tokyo (JP); Jun Goto, Tokyo (JP); Kazunari Kihira, Tokyo (JP); Tomohiro Takahashi, Tokyo (JP); Masataka Otsuka, Tokyo (JP); Narihiro Nakamoto, Tokyo (JP); Toru Fukasawa, Tokyo (JP); Takuro Sasaki, Tokyo (JP); Tomohiro Mizuno, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 129 days.

(21) Appl. No.: 16/327,648

(22) PCT Filed: Aug. 30, 2016

(86) PCT No.: PCT/JP2016/075289
§ 371 (c)(1),
(2) Date: Feb. 22, 2019

(87) PCT Pub. No.: WO2018/042508
PCT Pub. Date: Mar. 8, 2018

(65) Prior Publication Data

US 2019/0229418 A1 Jul. 25, 2019

(51) Int. Cl.
*H01Q 3/32* (2006.01)
*H01Q 13/22* (2006.01)
(Continued)

(52) U.S. Cl.
CPC ..... *H01Q 3/32* (2013.01); *H01Q 3/24* (2013.01); *H01Q 13/22* (2013.01); *H01Q 21/005* (2013.01); *H01Q 21/0043* (2013.01)

(58) Field of Classification Search
CPC .. H01Q 3/08; H01Q 1/18; H01Q 3/04; H01Q 13/02; H01Q 25/04; H01Q 13/10;
(Continued)

(56) References Cited

U.S. PATENT DOCUMENTS 1,208,093 A 12/1916 Chalasiewicz
2,602,893 A 7/1952 Ratliff, Jr.
(Continued)

FOREIGN PATENT DOCUMENTS

CA 2061627 A1 8/1992
EP 0921591 A1 4/1991
(Continued)

OTHER PUBLICATIONS

European Office Action, dated May 25, 2020, for European Application No. 15915069.5.
(Continued)

*Primary Examiner* — Minh D A
(74) *Attorney, Agent, or Firm* — Birch, Stewart, Kolasch & Birch, LLP

(57) ABSTRACT

An array antenna device, including: a waveguide (1) having a plurality of radiation units (2) arranged on one tube wall thereof, in which the waveguide (1) has a plurality of grooves (3) arranged on an inner side of a tube wall facing the tube wall, movable short-circuit surfaces (4) each electrically short-circuited to an inner wall of one of the grooves (3), and movable short-circuit surface controlling mechanisms (5) for changing positions of the movable short-circuit surfaces (4).

10 Claims, 11 Drawing Sheets

(51) Int. Cl.
*H01Q 21/00* (2006.01)
*H01Q 3/24* (2006.01)

(58) Field of Classification Search
CPC ..... H01Q 13/085; H01Q 1/38; H01Q 13/18; H01Q 13/106; H01Q 3/32; H01Q 3/24; H01Q 21/0043; H01Q 21/005; H01Q 13/22
See application file for complete search history.

(56) References Cited

U.S. PATENT DOCUMENTS

| | | | | |
|---|---|---|---|---|
| 6,154,176 | A * | 11/2000 | Fathy | H01Q 1/38 343/700 MS |
| 2004/0257288 | A1* | 12/2004 | Robertson, Jr. | H01Q 3/34 343/772 |
| 2005/0206573 | A1* | 9/2005 | Iigusa | H01Q 15/02 343/770 |

FOREIGN PATENT DOCUMENTS

| | | | | |
|---|---|---|---|---|
| JP | 50-29400 | Y1 | | 8/1975 |
| JP | 53-135239 | A | | 11/1978 |
| JP | 03-085906 | A | | 4/1991 |
| JP | 5-63409 | A | | 3/1993 |
| JP | 5-63436 | A | | 3/1993 |
| JP | 2004-229124 | A | | 8/2004 |
| JP | 2007-18923 | A | | 1/2007 |
| JP | 2008-205588 | A | | 9/2008 |
| JP | 2008205588 | A | * | 9/2008 |

OTHER PUBLICATIONS

Extended European Search Report issued in corresponding European Patent Application No. 16915069.5, dated Jul. 31, 2019.
International Search Report (PCT/ISA/210) issued in PCT/JP2016/075289, dated Nov. 22, 2016.
Office Action issued in corresponding European Application No. 16915069.5 dated Jan. 14, 2020.

* cited by examiner

ARRAY ANTENNA DEVICE

TECHNICAL FIELD

The present invention relates to an array antenna device having variable directivity.

BACKGROUND ART

In recent years, what is desired in radar and wireless communication includes high gain that allows transmission and reception of even a weak radio wave and wide coverage characteristics that enable detection or communication in a wide angle range, and thus array antenna devices having variable directivity is attracting attention.

In order to implement variable directivity in a waveguide slot array antenna which is one of typical array antenna devices, a mechanism is necessary for changing the excitation phase of a plurality of radiation elements (slots) arranged in a waveguide.

Methods to change the excitation phase of slots include changing the geometry of the waveguide and changing the position where the slots are arranged.

For example, Patent Literature 1 describes an antenna device in which the excitation phase is allowed to be changed by providing a movable structure inside a waveguide in a protruding manner on a surface facing a tube wall on which slots are arranged.

Patent Literature 2 also discloses an antenna device in which a diode is loaded to every slot of the array antenna and the position of the slots are changed by switching the state of the diodes.

CITATION LIST

Patent Literatures

Patent Literature 1: JP 2008-205588 A
Patent Literature 2: JP H05-063409 A

SUMMARY OF INVENTION

Technical Problem

However, in Patent Literature 1, since the geometry of the waveguide is changed by allowing the movable structure to protrude in the waveguide, there are problems that the input impedance varies and that this results in deterioration of reflection characteristics.

In addition, in Patent Literature 2, there is a problem that radiation efficiency is lowered since switches are directly provided to the slots.

Solution to Problem

The present invention has been made to solve the problems as described above, and it is an object of the present invention to provide an array antenna device, including: a waveguide having a plurality of radiation units arranged on one tube wall thereof, in which the waveguide has a plurality of grooves arranged on an inner side of a tube wall facing the tube wall, movable short-circuit surfaces each electrically short-circuited to an inner wall of one of the grooves, and movable short-circuit surface controlling mechanisms for changing positions of the movable short-circuit surfaces, and the movable short-circuit surface controlling mechanisms simultaneously change positions of a plurality of movable short-circuit surfaces out of the movable short-circuit surfaces.

Advantageous Effects of Invention

According to the present invention, an array antenna device having variable directivity can be provided without deteriorating reflection characteristics.

DESCRIPTION OF EMBODIMENTS

First Embodiment

An array antenna device according to the present embodiment will be described with reference to FIGS. 1 to 3.

Figure 1:
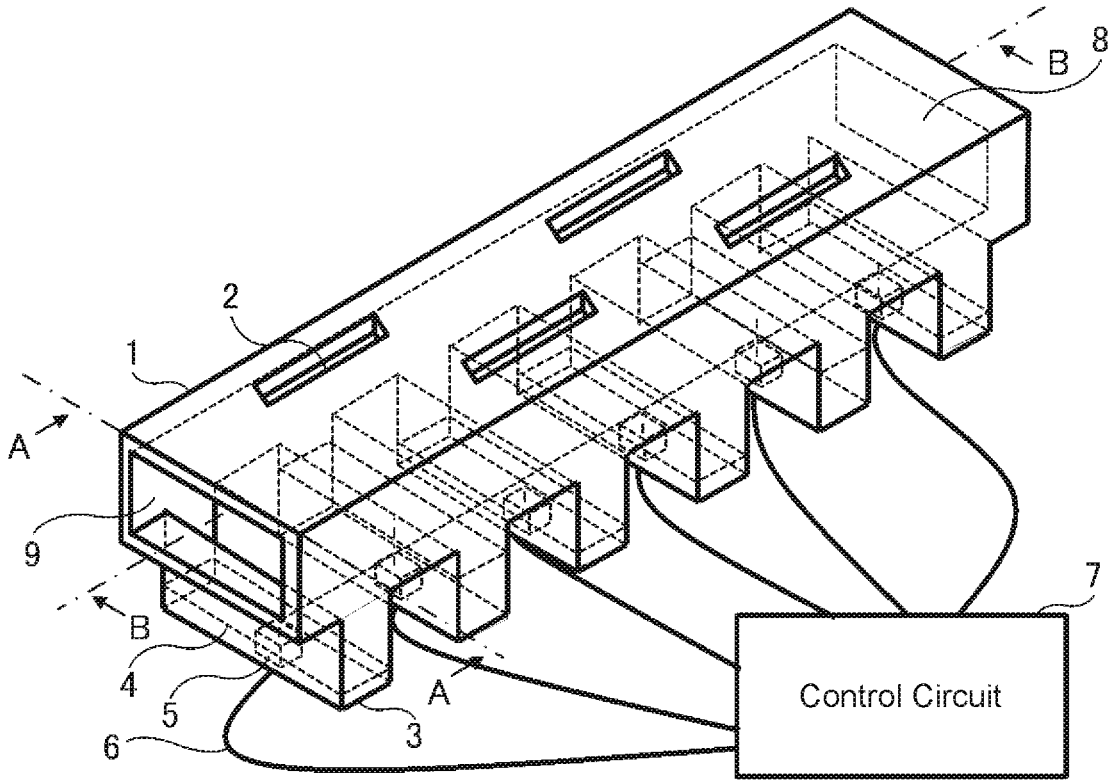
FIG. 1 is a perspective view of an array antenna device according to a first embodiment.
Figure 2:
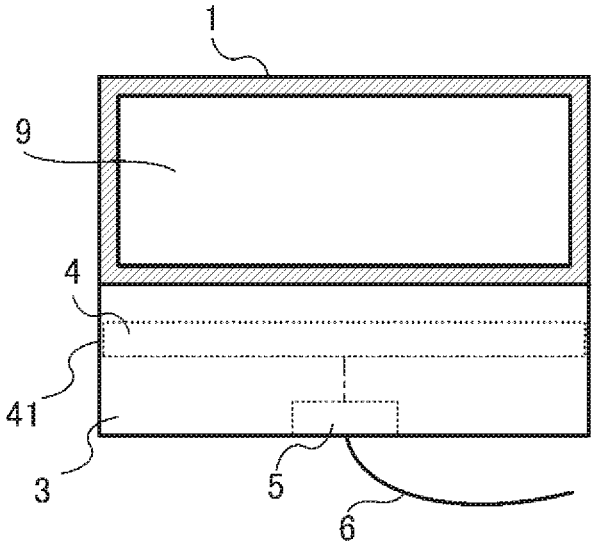
FIG. 2 is a side view of the array antenna device according to the first embodiment.
Figure 3:
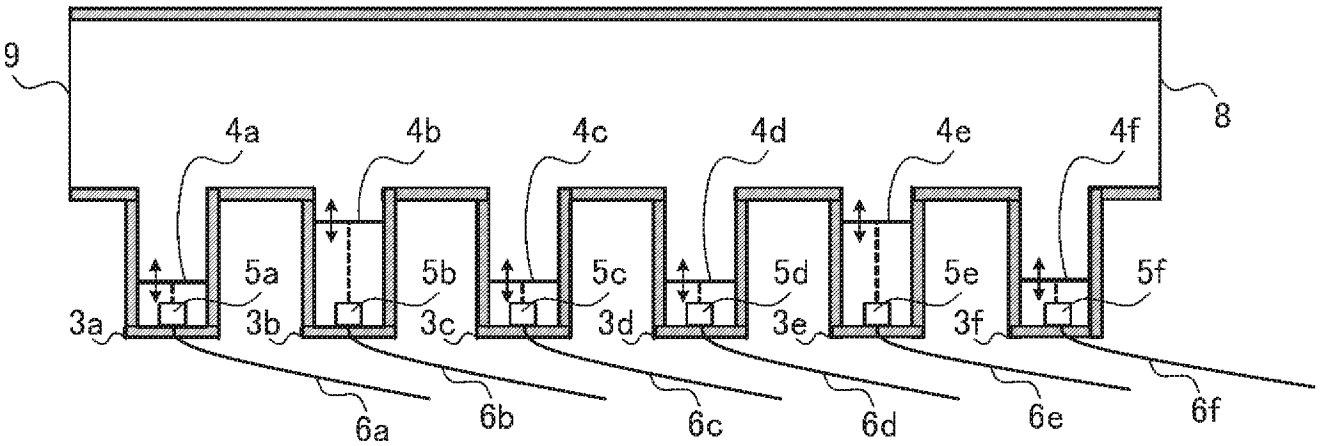
FIG. 3 is a cross-sectional view of the array antenna device according to the first embodiment.

FIG. 1 is a perspective view of the array antenna device according to the first embodiment, FIG. 2 is a side view when viewed from a direction of A-A in FIG. 1, and FIG. 3 is a cross-sectional view when viewed from a direction of B-B in FIG. 1.

In FIGS. 1 to 3, a symbol 1 denotes a waveguide, 2 denotes a slot (radiation unit), 3 and 3*a* to 3*f* denote grooves, 4 and 4*a* to 4*f* denote movable short-circuit surfaces (short-circuit surfaces), 41 denotes a side wall of a movable short-circuit surface, 5 and 5*a* to 5*f* denote movable short-circuit surface controlling mechanisms (operation units), 6 and 6*a* to 6*f* denote control lines, 7 denotes a control circuit, 8 denotes a waveguide terminal end, and 9 denotes an input terminal.

A movable short-circuit surface controlling mechanism 5 for operating a movable short-circuit surface 4 is connected to the control circuit 7 via a control line 6.

A slot 2 is provided on a wide wall surface of the waveguide 1 and has a length of approximately a half of a wavelength of an operation frequency. Slots 2 are arranged along the tube axis of the waveguide 1 within a length of approximately one wavelength of the operation frequency. At this time, the slots are alternately arranged across the central axis of the wide wall surface. In this case, note that the plane orthogonal to the tube axis direction is the polarization plane of the antenna.

The grooves 3 have a depth of less than or equal to approximately a half of the wavelength and is cyclically arranged at positions facing the wall surface, on which the slots 2 are arranged, at intervals of less than or equal to approximately a half of the wavelength of the operation frequency. The above also applies to the grooves 3*a* to 3*f*.

A movable short-circuit surface 4 is a conductor arranged inside a groove 3, and a surface thereof facing the waveguide 1 is flat. The above applies to the movable short-circuit surfaces 4*a* to 4*f* as well. In the present embodiment, the case where the movable short-circuit surface 4*a* is in the groove 3*a*, the movable short-circuit surface 4*b* is in the groove 3*b*, the movable short-circuit surface 4*c* is in the groove 3*c*, the movable short-circuit surface 4*d* is in the groove 3*d*, the movable short-circuit surface 4*e* is in the groove 3*e*, and the movable short-circuit surface 4*f* is in the groove 3*f* will be described.

Note that it is assumed that a movable short-circuit surface 4 can be moved to a desired position in a groove 3 and that the movable short-circuit surface 4 is electrically short-circuited via a side wall 41 with an inner wall of the groove 3 which the movable short-circuit surface 4 is in contact with. The side wall 41 refers to a side surface of the movable short-circuit surface 4 which is in close contact with the inner wall of the groove 3.

Side walls are similarly referred to in the movable short-circuit surfaces 4*a* to 4*f* as well (symbols are omitted).

A movable short-circuit surface controlling mechanism 5 is a motor or an actuator, which is arranged in each of the grooves and is used for changing the position of a movable short-circuit surface. The above applies to the movable short-circuit surface controlling mechanisms 5*a* to 5*f* as well. In the present embodiment, the movable short-circuit surface controlling mechanism 5*a* is installed in the groove 3*a* for changing the position of the movable short-circuit surface 4*a*, the movable short-circuit surface controlling mechanism 5*b* is installed in the groove 3*b* for changing the position of the movable short-circuit surface 4*b*, the movable short-circuit surface controlling mechanism 5*c* is installed in the groove 3*c* for changing the position of the movable short-circuit surface 4*c*, the movable short-circuit surface controlling mechanism 5*d* is installed in the groove 3*d* for changing the position of the movable short-circuit surface 4*d*, the movable short-circuit surface controlling mechanism 5*e* is installed in the groove 3*e* for changing the position of the movable short-circuit surface 4*e*, the movable short-circuit surface controlling mechanism 5*f* is installed in the groove 3*f* for changing the position of the movable short-circuit surface 4*f*.

A control line 6 includes a conductor line that is shielded and is used for connecting a movable short-circuit surface controlling mechanism 5 and the control circuit 7.

Note that a control line 6 is connected to a movable short-circuit surface controlling mechanism 5 in a groove 3 through a hole smaller than a wavelength input to the waveguide 1. The above applies to the control lines 6*a* to 6*f* as well. In the present embodiment, the control line 6*a* connects the movable short-circuit surface controlling mechanism 5*a* and the control circuit 7, the control line 6*b* connects the movable short-circuit surface controlling mechanism 5*b* and the control circuit 7, the control line 6*c* connects the movable short-circuit surface controlling mechanism 5*c* and the control circuit 7, the control line 6*d* connects the movable short-circuit surface controlling mechanism 5*d* and the control circuit 7, the control line 6*e* connects the movable short-circuit surface controlling mechanism 5*e* and the control circuit 7, the control line 6*f* connects the movable short-circuit surface controlling mechanism 5*f* and the control circuit 7.

In the present embodiment, the case where six sets of a groove 3, a movable short-circuit surface 4, a movable short-circuit surface controlling mechanism 5, and a control line 6 are prepared has been described; however, any number of the above sets may be employed.

The control circuit 7 outputs an instruction based on setting data to the movable short-circuit surface controlling mechanisms 5*a* to 5*f* and moves the respective movable short-circuit surfaces 4*a* to 4*f* installed in the respective grooves 3*a* to 3*f* to desired positions. Note that the control circuit 7 is capable of separately changing the movable short-circuit surfaces 4*a* to 4*f* to different positions by separately giving instructions of movement to the movable short-circuit surface controlling mechanisms 5*a* to 5*f*.

Figure 4:
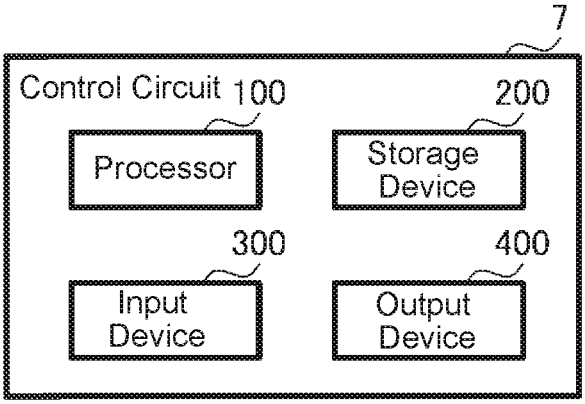
FIG. 4 is a hardware configuration diagram of a control circuit 7.

FIG. 4 is a block diagram schematically illustrating a specific example of a hardware configuration of the control circuit 7. As illustrated in FIG. 4, the control circuit 7 has a processor 100 for controlling the movable short-circuit surface controlling mechanisms 5*a* to 5*f*, a storage device 200, an input device 300, and an output device 400.

The storage device 200 is a collective name for memories including a read only memory (ROM) and random access memory (RAM) and external storage devices such as a hard disk. The storage device 200 is read or written programs or data by the processor 100 and is used as a storage of temporary data. A program (control program) for controlling the movable short-circuit surface controlling mechanisms 5*a* to 5*f* is also stored in the storage device 200.

The input device 300 may include a keyboard, a mouse, a touch pad, a wired or wireless communication interface, an input device such as speech recognition or various sensors, programs for controlling the input device such as various sensors, communication paths, etc. Note that in a case where the control program for controlling the movable short-circuit surface controlling mechanisms 5 is operable with only preset information and no instruction from an operator is required, the input device 300 is not necessary.

The output device 400 may be a substrate to which the control lines 6 are connected or may be an input/output port of the processor 100.

Next, the operation of the array antenna device according to the present embodiment will be described.

The array antenna device according to the present embodiment is a traveling wave antenna used through terminating or short-circuiting the waveguide terminal end 8 by a dummy resistor and radiates a radio wave input from the input terminal 9 from the slots 2.

Moreover, the grooves 3*a* to 3*f* are provided with movable short-circuit surfaces 4*a* to 4*f*, respectively, that are formed by a conductor therein, and the movable short-circuit surfaces 4*a* to 4*f* in all the grooves can be separately controlled of the position thereof by the movable short-circuit surface controlling mechanisms 5*a* to 5*f*, respectively.

When positions of the movable short-circuit surfaces 4*a* to 4*f* inside the grooves 3*a* to 3*f* change, a wavelength inside the waveguide 1 changes. This change in the wavelength inside the waveguide results in a change in the excitation phase of the slots 2, thus enabling variable directivity.

The grooves 3*a* to 3*f* operate as inductive loads when the movable short-circuit surfaces 4*a* to 4*f* therein are positioned within a length of a quarter of the wavelength inside the waveguide from the inner wall of the waveguide 1. In addition, if the length is within a range of a quarter to a half of the wavelength, the grooves 3*a* to 3*f* operate as capacitive loads.

That is, an input impedance varies and thus reflection characteristics are deteriorated depending on the positions of the movable short-circuit surfaces 4*a* to 4*f* in the grooves. Therefore, in the present embodiment, by operating positions of the movable short-circuit surfaces as described below, the problem that the input impedance varies and thus reflection characteristics are deteriorated depending on the positions of the movable short-circuit surfaces 4*a* to 4*f* is solved.

Figure 5:
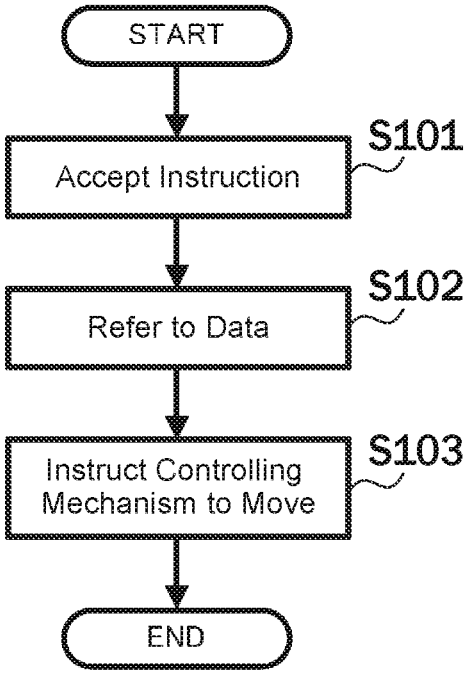
FIG. 5 is a flowchart illustrating the operation of the control circuit 7.

FIG. 5 is a processing flow at the time when the control circuit 7 according to the present embodiment operates. In the present embodiment, a case where an instruction to change the directivity is received from an operator will be described. The control circuit 7 accepts the instruction to change the directivity from the operator (S101). Next, the control circuit 7 refers to setting data corresponding to the accepted directivity (S102). Then, the control circuit 7 operates the movable short-circuit surface controlling mechanisms 5*a* to 5*f* of the respective grooves on the basis of the setting data to operate the positions of the movable short-circuit surfaces 4*a* to 4*f* (S103).

Next, setting data will be described with reference to FIGS. 6 and 7.

Figure 6:
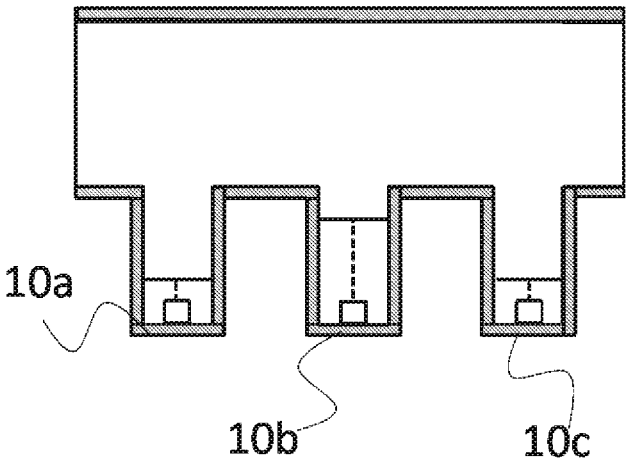
FIG. 6 is a cross-sectional view of the array antenna device according to the first embodiment when three grooves are formed therein.

FIG. 6 is a cross-sectional view of the array antenna device according to the present embodiment formed with three grooves 10*a*, 10*b*, and 10*c*.

Figure 7:
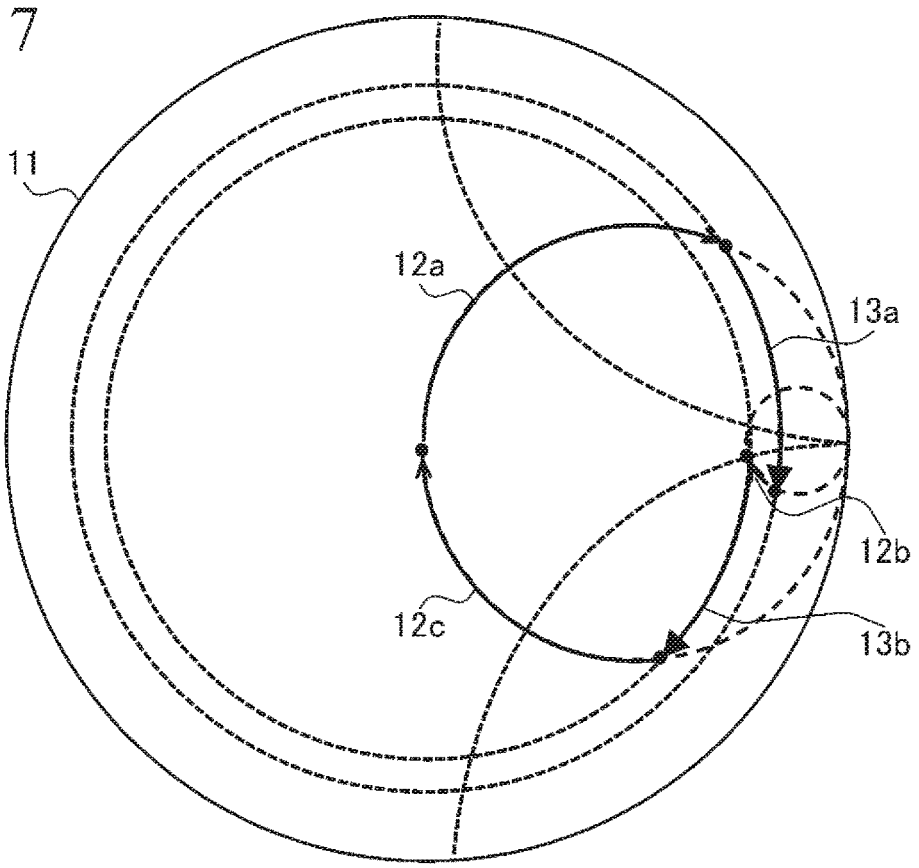
FIG. 7 is a Smith chart of the array antenna device according to the first embodiment.

FIG. 7 is a Smith chart in the case where the grooves 10*a*, 10*b*, and 10*c* illustrated in FIG. 6 are used as inductive loads and are arranged while equally spaced. In the absence of the grooves 10*a*, 10*b*, and 10*c* on a Smith chart 11, an input impedance is positioned in the center.

Since arrangement of one groove of the groove 10*c* results in inductive operation, the input impedance changes as illustrated by a locus 12*a*. At this time, the amount of change of the input impedance can be adjusted by the position of a movable short-circuit surface.

Moreover, arrangement of the groove 10*b* at a distance within a half of the wavelength apart, the input impedance changes along a locus 13*a* and a locus 12*b*.

Furthermore, since a similar structure is arranged while equally spaced, the input impedance is allowed to return to the center on the Smith chart along 13*b* and 12*c*. The amounts of changes in the loci 13*a* and 13*b* are fixed since the amounts are caused by the intervals at which the grooves are arranged.

On the other hand, the amounts of changes in the loci 12*a*, 12*b*, and 12*c* can be adjusted by the position of the movable short-circuit surfaces. By varying the amounts of changes in the loci 12*a*, 12*b*, and 12*c*, the wavelength inside the waveguide changes, thus enabling variable directivity.

Note that, in the example of the Smith chart 11 used in the present embodiment, the case where the amount of change in the locus 12*a* is relatively large has been illustrated; however in the case where the amount of change in the locus 12*a* is small, that is, the case where the position of the movable short-circuit surface is arranged near the bottom surface of the waveguide 1, it is only required to reduce also the amount of change in the locus 12*c* or 12*b*.

By adjusting the positions of the movable short-circuit surfaces in the grooves, the input impedance can be kept constant.

The case where there are three grooves has been described in the present embodiment; however even in the case where there are four or more grooves, the input impedance can be kept constant by adjusting the positions of the movable short-circuit surfaces of the grooves by using setting data similarly obtained from a Smith chart.

As described above, by adjusting the positions of the respective movable short-circuit surfaces on the basis of the setting data obtained from the Smith chart, the input impedance is allowed to be constant even when the directivity is changed, thus implementing a highly efficient antenna in which reflection characteristics are not deteriorated.

Note that the slots 2 used in this embodiment are drawn in rectangular shapes along the tube axis; however, the slots 2 may have any shape. Moreover, the radiation elements may not be the slots but may be probe-fed elements.

Second Embodiment

In the first embodiment, the array antenna device in the case where a movable short-circuit surface 4 is in contact with an inner wall of a groove 3 via a side wall 41 has been described.

In the present embodiment, an array antenna device in which abrasion of movable short-circuit surfaces 4 is prevented will be described.

Figure 8:
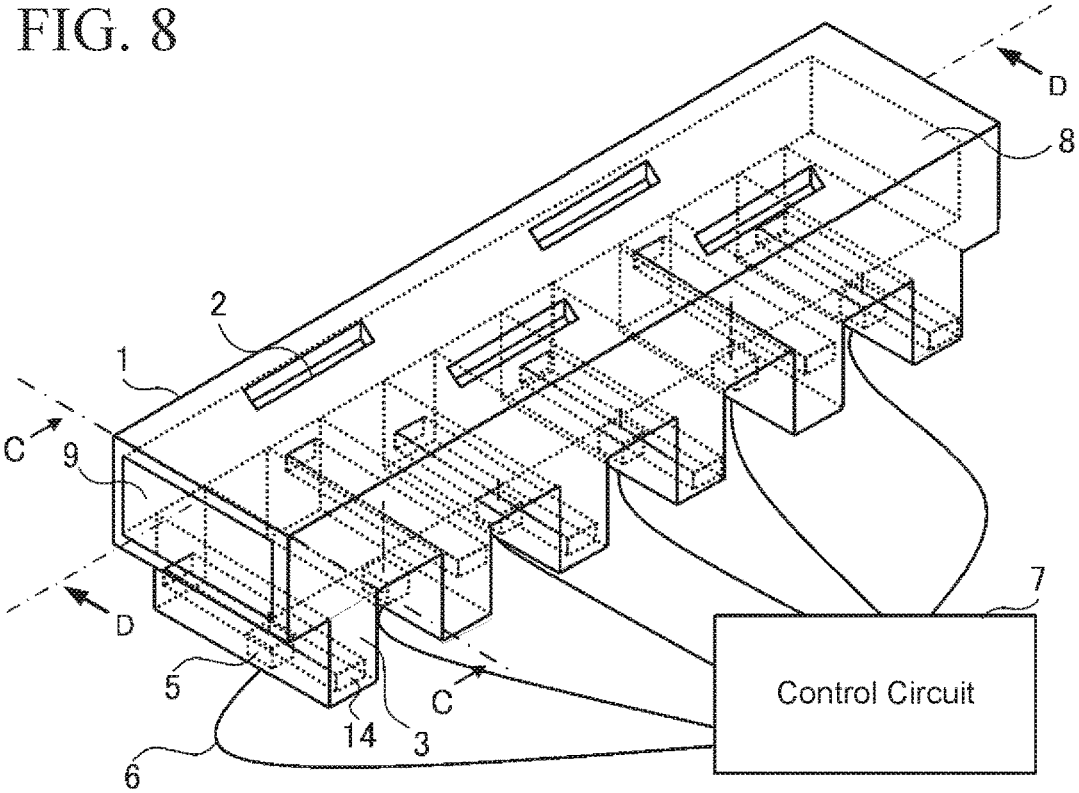
FIG. 8 is a perspective view of an array antenna device according to a second embodiment.
Figure 9:
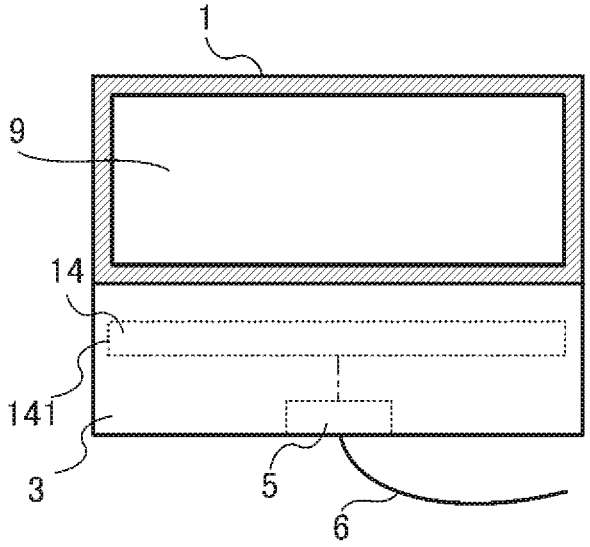
FIG. 9 is a side view of the array antenna device according to the second embodiment.
Figure 10:
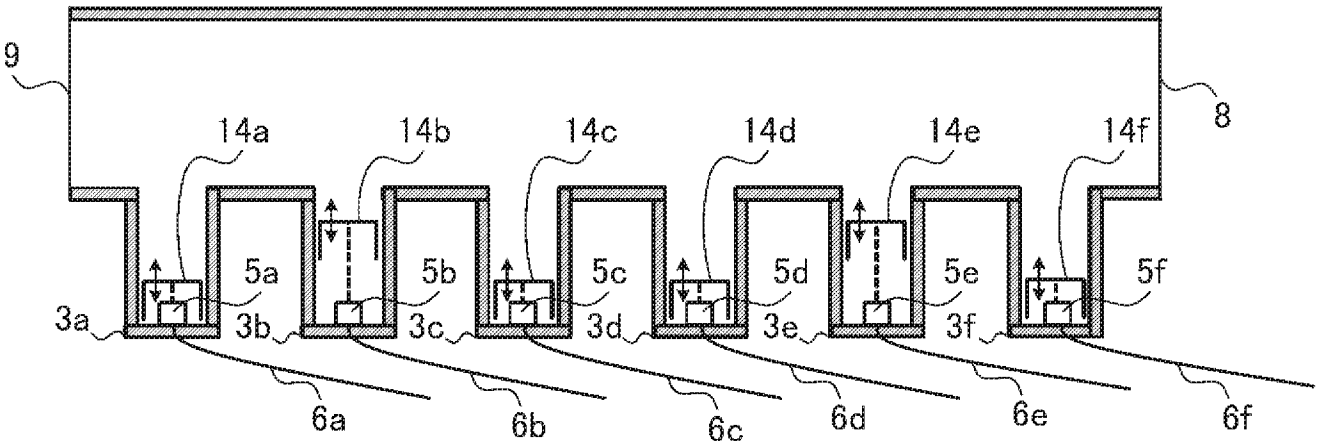
FIG. 10 is a cross-sectional view of the array antenna device according to the second embodiment.

FIGS. 8, 9, and 10 are diagrams schematically illustrating the array antenna device according to the second embodiment of the present invention.

FIG. 8 is a perspective view of the antenna device according to the present embodiment, FIG. 9 is a cross-sectional view when viewed from a direction of C-C in FIG. 8, and FIG. 10 is a cross-sectional view when viewed from a direction of D-D in FIG. 8.

In FIGS. 8, 9, and 10, symbols 14 and 14*a* to 14*f* denote movable short-circuit surfaces described in the present embodiment. Further, symbol 141 denotes a side wall of a movable short-circuit surface 14 described in the present embodiment. Note that in FIGS. 8, 9, and 10, the same symbols as those in FIGS. 1 to 3 denote the same or corresponding parts.

Although the array antenna device according to the present embodiment has the same basic configuration as that of the first embodiment, a different point is that the movable short-circuit surfaces are not in contact with grooves.

As illustrated in FIG. 10, the present embodiment has choke structures in the side walls 141 of the movable short-circuit surfaces 14*a* to 14*f*, the choke structures each having a length of an odd multiple of a quarter of a wavelength toward the bottom surface of a groove. Due to these choke structures, gaps are provided between the movable short-circuit surfaces 14*a* to 14*f* and grooves 3*a* to 3*f*.

As described above, since no electromagnetic field enters below the movable short-circuit surfaces 4, the input impedance is not affected and is constant, and thus not only that reflection characteristics are not deteriorated, but also that abrasion of the movable short-circuit surfaces can be prevented.

Third Embodiment

In the first and second embodiments, the array antenna device in the case where the movable short-circuit surfaces are made of a conductor has been described. In the present embodiment, however, an array antenna device in which a plurality of switches such as diodes are used instead of the movable short-circuit surfaces will be described.

Figure 11:
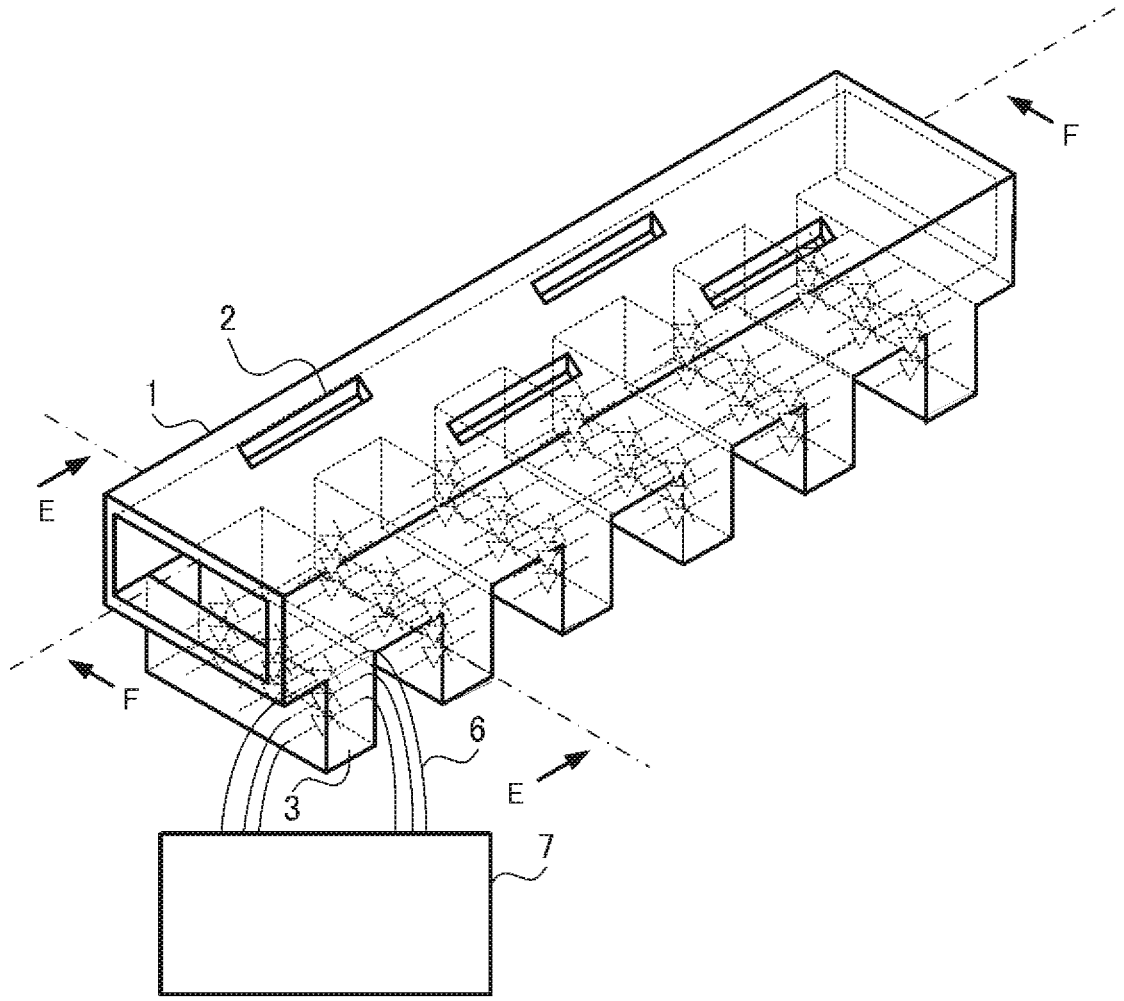
FIG. 11 is a perspective view of an array antenna device according to a third embodiment.
Figure 12:
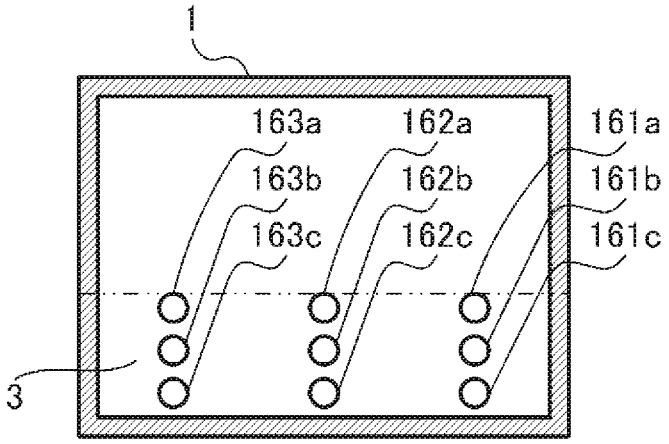
FIG. 12 is a side view of the array antenna device according to the third embodiment.
Figure 13:
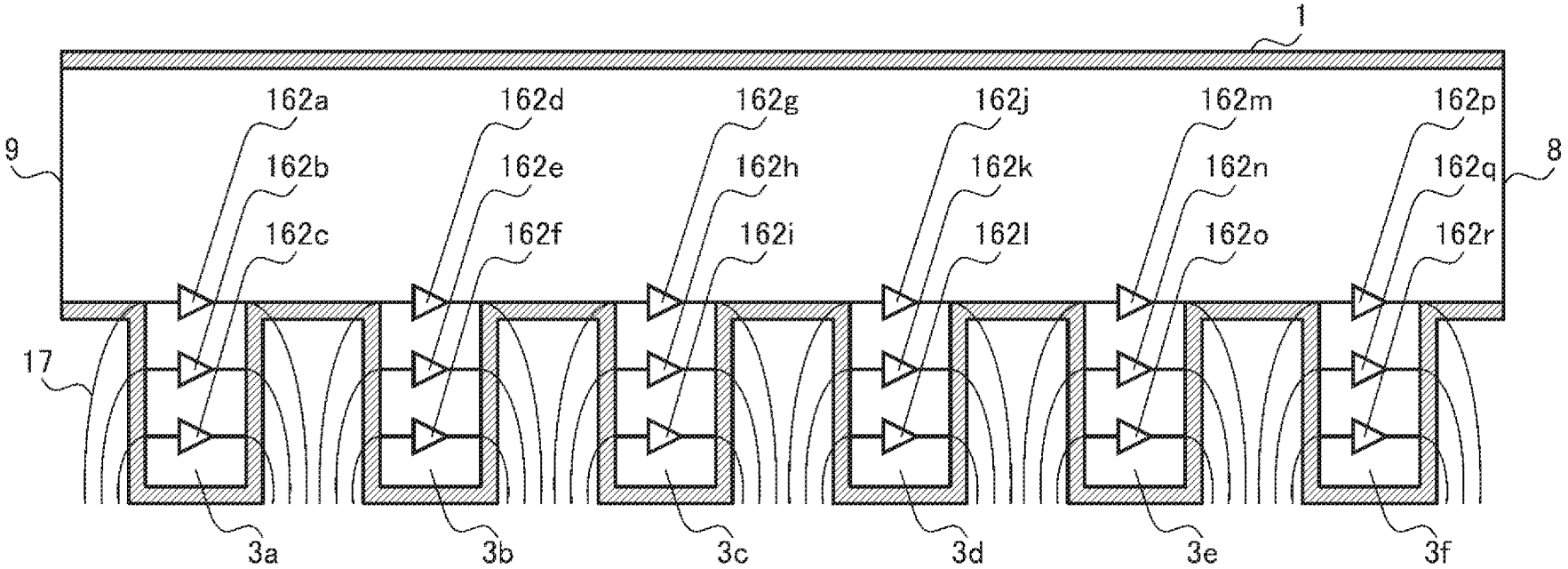
FIG. 13 is a cross-sectional view of the array antenna device according to the third embodiment.

FIGS. 11, 12, and 13 are diagrams schematically illustrating an array antenna device according to this embodiment.

FIG. 11 is a perspective view of the antenna device according to the present embodiment, FIG. 12 is a cross-sectional view when viewed along E-E in FIG. 11, and FIG. 13 is a cross-sectional view when viewed along F-F in FIG. 11.

In FIGS. 11, 12, and 13, symbols 161*a* to 161*c*, 162*a* to 162*r*, and 163*a* to 163*c* denote diodes and are connected to a control circuit 7 by control lines 6.

In the present embodiment, the control lines 6 are conducting wires for supplying a current to the diodes, and the control circuit 7 operates a power supply (not illustrated) for individually supplying a current to each of the diodes. In FIGS. 11, 12, and 13, the same symbols as those in FIGS. 1 to 3 and FIGS. 8 and 9 denote the same or corresponding parts. Note that FIGS. 11, 12, and 13 illustrate that all the diodes are turned off.

In the present embodiment, the movable short-circuit surfaces are replaced with the diodes. Diodes are loaded at multiple different heights within a groove at predetermined intervals, and at each of the heights, one or more diodes are loaded. In FIGS. 11, 12 and 13, an example is illustrated where three diodes are used to form one height (movable short-circuit surface) and three stages of heights are set.

When diodes out of the diodes in the respective grooves at one height are turned on by the control lines 6 wired from the control circuit, an electrical short-circuit surface is formed at the position of those diodes. For example, in FIG. 12, by turning on only the diodes 161*b*, 162*b*, and 163*b*, it is possible to form an electrical short-circuit surface at a height in the middle.

A method of controlling the position of electrical short-circuit surfaces by the diodes corresponds to that of the first embodiment. That is, by controlling the positions of diodes in a groove, an input impedance is allowed to move to the vicinity of the center of a Smith chart.

In the first embodiment, the positions of the movable short-circuit surfaces can be controlled in a continuous manner, whereas in the third embodiment, since the diodes are arranged at different heights at predetermined intervals, short-circuit surfaces can be controlled to be only at discrete positions. Therefore, the positions of short-circuit surfaces, in the third embodiment, corresponding to the loci 12*a*, 12*b*, and 12*c* illustrated in FIG. 7 are allowed to move to the vicinity of the center of the Smith chart by turning on diodes at a height close to the positions of the movable short-circuit surfaces of the first embodiment.

As described above, by adopting a configuration in which the plurality of switches is arranged in each of the grooves, it is possible to obtain equivalent effects to those of the first embodiment and to control positions of short-circuit surfaces at a high speed.

Note that although diodes are used in this embodiment, the diodes can be replaced by switches such as MEMS switches or FET switches.

Fourth Embodiment

In the first and second embodiments, the array antenna devices in which positions of the movable short-circuit surfaces installed inside the respective grooves are controlled by the control circuit separately controlling the movable short-circuit surface controlling mechanisms each placed inside each of the grooves have been described. In the present embodiment, an array antenna device in which the movable short-circuit surface controlling mechanisms placed in the respective grooves are shared and a shared controlling mechanism for simultaneously controlling a plurality of movable short-circuit surfaces is used will be described.

Figure 14:
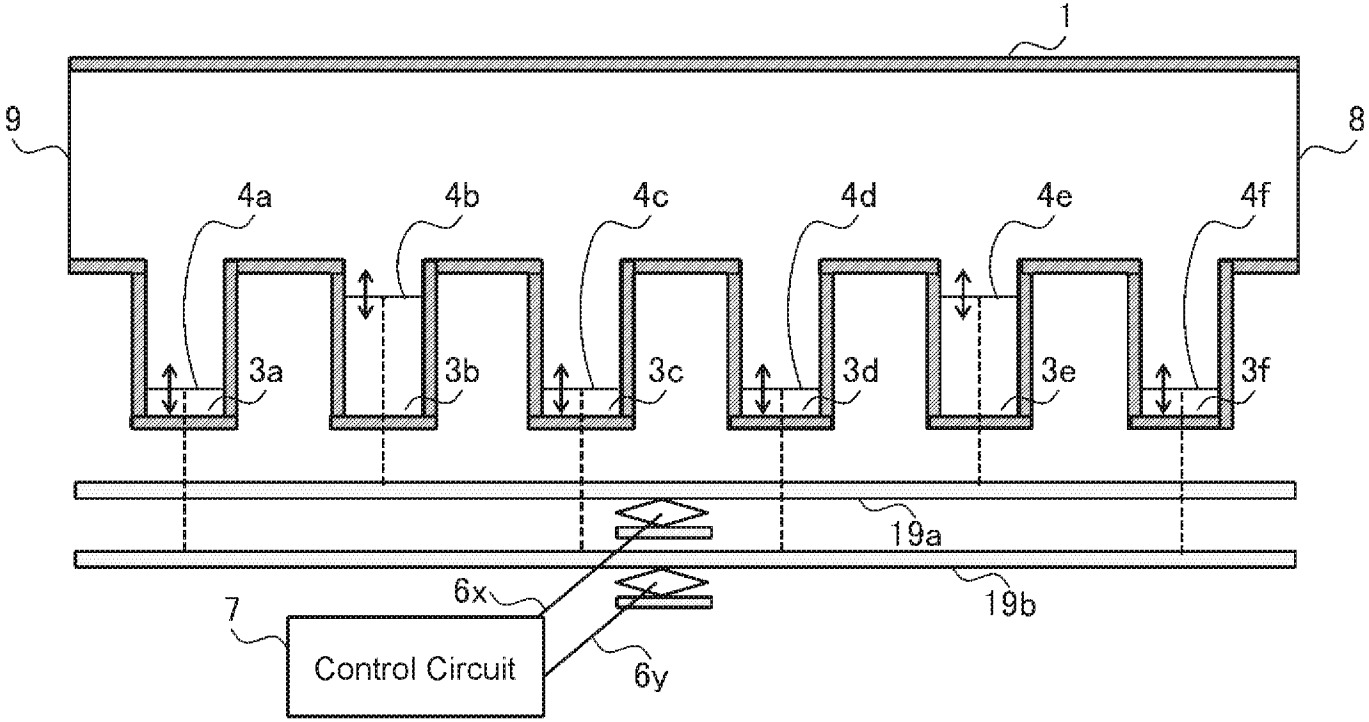
FIG. 14 is a cross-sectional view of an array antenna device according to a fourth embodiment.

FIG. 14 is a diagram schematically illustrating an array antenna device according to the present embodiment and illustrates a cross-sectional view thereof. In FIG. 14, symbols 6*x* and 6*y* denote control lines, and symbols 19*a* and 19*b* denote shared controlling mechanisms. In FIG. 14, the same symbols as those in FIG. 3 denote the same or corresponding parts. Note that, in FIG. 14, the configuration of the movable short-circuit surfaces 4 used in the first embodiment is illustrated for the sake of convenience; however, the configuration of the movable short-circuit surfaces 14 used in the second embodiment may be employed.

The shared controlling mechanism 19*a* is controlled by a controlling mechanism 7 via the control line 6*x*. Likewise, the shared controlling mechanism 19*b* is controlled by the controlling mechanism 7 via the control line 6*y*. Like the movable short-circuit surface controlling mechanisms, a shared controlling mechanism may include a motor, an actuator, or the like and may further include, for example, rods or the like for operating a plurality of movable short-circuit surfaces from a plate as illustrated in FIG. 14 such that the movable short-circuit surfaces are allowed to move to the same height (a position in a groove) at a time. In FIG. 14, an example is illustrated where the shared controlling mechanism 19*a* simultaneously controls movable short-circuit surfaces 4*b* and 4*e*, and the shared controlling mechanism 19*b* simultaneously controls movable short-circuit surfaces 4*a*, 4*c*, 4*d*, and 4*f*.

As described in the first embodiment, in the present invention, the position of a movable short-circuit surface is controlled for each groove. As is clear from the Smith chart illustrated in FIG. 7, in the case where the three grooves 10*a*, 10*b*, and 10*c* are formed as illustrated in FIG. 6, positions of the movable short-circuit surfaces of the grooves 10*b* and 10*c* are set so as to cancel an inductive component of the groove 10*a*, and thus the grooves 10*a* and 10*c* are arranged at equivalent heights.

That is, in the case where there is a plurality of movable short-circuit surfaces arranged at equal heights, the movable short-circuit surfaces can be operated simultaneously by using the shared controlling mechanisms 19*a* and 19*b*.

As described above, by using the shared controlling mechanisms for simultaneously controlling movable short-circuit surfaces arranged at the same height, equivalent effects as those in the first embodiment can be obtained while the control circuit can be simplified, thus enabling implementation of an array antenna device at low costs.

Fifth Embodiment

Figure 15:
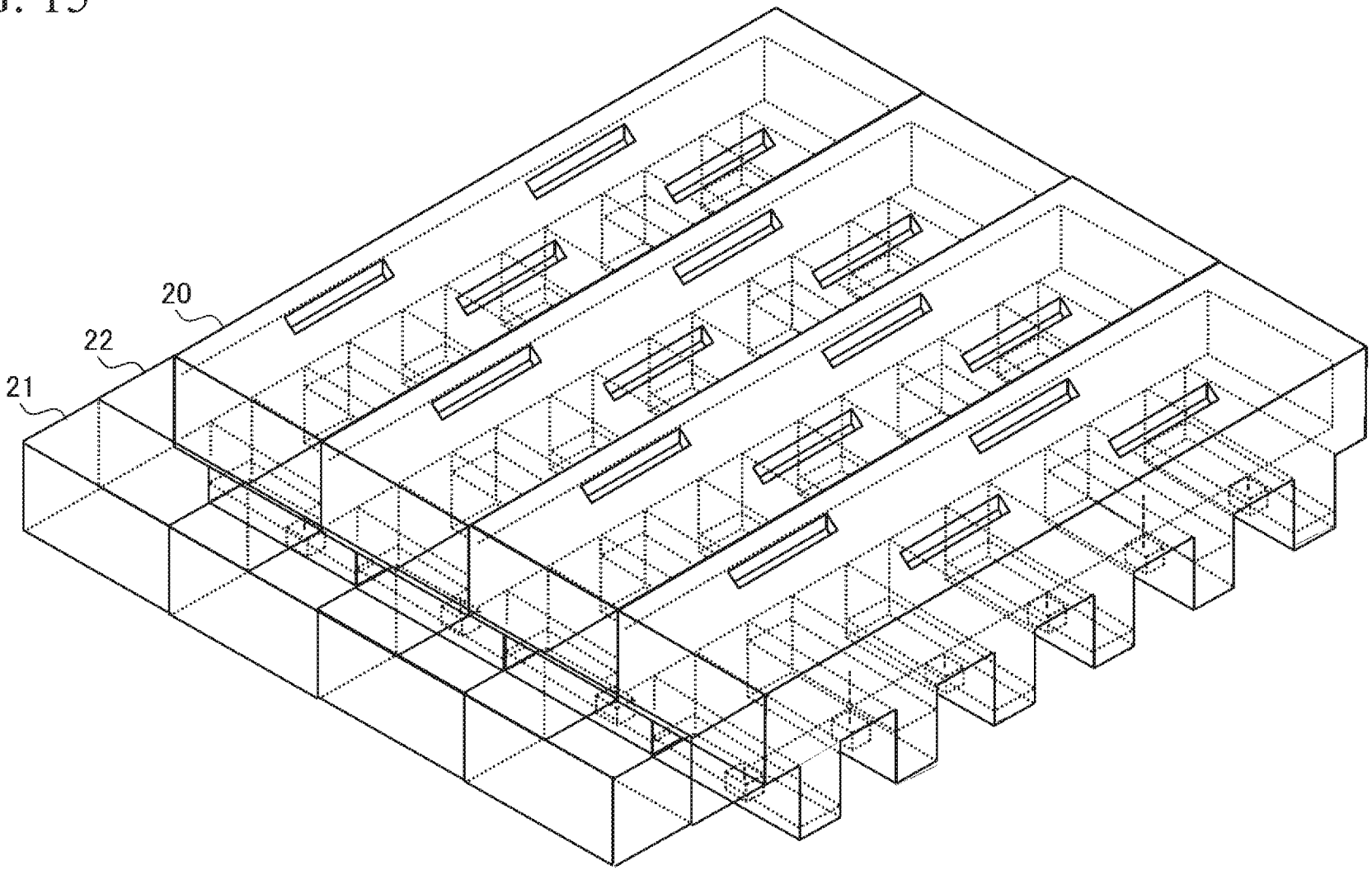
FIG. 15 is a perspective view of an array antenna device according to a fifth embodiment.

In the first to fourth embodiments, the array antenna devices in which the radiation elements are arrayed along the tube axis have been described. In the present embodiment, an array antenna device in which a plurality of radiation elements are arranged in a planar shape will be described. FIG. 15 is a perspective view schematically illustrating an array antenna device according to the present embodiment. In FIG. 15, symbol 20 denotes an array antenna device, symbol 21 denotes a phase shifter, and symbol 22 denotes an amplifier. The array antenna devices 20 are connected with the amplifier 22, and the amplifier 22 is connected with the phase shifter 21. Note that the array antenna devices 20 may be any one of the array antenna devices described in the first to fourth embodiments. In the example of FIG. 15, a combination of four array antenna devices described in the first embodiment is described as an example; however, the number of the array antenna devices 20 may be any number. In the case where a plurality of array antenna devices 20 is used, the array antenna devices 20 are arrayed in parallel such that tube axis directions of the array antenna devices 20 are parallel to each other.

The phase shifter 21 changes the phase of an input signal and outputs the signal to the amplifier 22. The amplifier 22 amplifies the phase-changed signal output from the phase shifter 21 and outputs the signal to the array antenna devices 20. In this manner, by connecting the amplifier 22 and the phase shifter 21 to the array antenna device 20 and arraying the array antenna devices 20 in parallel such that the tube axis directions thereof are parallel to each other, that is, by arraying the array antenna devices into a planar shape, two-dimensional directivity is allowed to be variable. As described above, it is not only that equivalent effects to those of the first embodiment can be obtained, but also that a higher gain than that of the related art can be obtained.

REFERENCE SIGNS LIST

1: Waveguide, 2: Slot, 3, 3*a* to 3*f*: Groove, 4, 4*a* to 4*f*: Movable short-circuit surface, 5, 5*a* to 5*f*: Movable short-circuit surface controlling mechanism, 6, 6*a* to 6*f*, 6*y*, 6*z*: Control line, 7: Control circuit, 8: Waveguide terminal end, 9: Input terminal, 10*a*, 10*b*, 10*c*: Groove, 11: Smith chart, 12*a*, 12*b*, 12*c*, 13*a*, 13*b*: Change in locus due to variation in input impedance, 14, 14*a* to 14*f*: Movable short-circuit surface having choke structure, 161*a* to 161*c*, 162*a* to 162*r*, 163*a* to 163*c*: Diode, 19*a*, 19*b*: Shared controlling mechanism, 20: Array antenna device, 21: Amplifier, 22: Phase shifter, 41, 141: Side wall, 100: Processor, 200: Storage device, 300: Input device, 400: Output device

What is claimed is:

1. An array antenna device, comprising:

a waveguide having a plurality of radiation units arranged on one tube wall thereof, wherein the waveguide has a plurality of grooves arranged on an inner side of a tube wall facing the tube wall, movable short-circuit surfaces each electrically short-circuited to an inner wall of one of the plurality of the grooves, and movable short-circuit surface controlling mechanisms for changing positions of the movable short-circuit surfaces within the plurality of groves in the waveguide, and the movable short-circuit surface controlling mechanisms simultaneously change positions of a plurality of movable short-circuit surfaces out of the movable short-circuit surfaces.

2. The array antenna device according to claim 1, wherein the movable short-circuit surfaces are conductors each having an inner wall that is in contact with an inner wall of one of the plurality of the grooves.

3. The array antenna device according to claim 2, wherein the movable short-circuit surfaces have a choke structure.

4. The array antenna device according to claim 1, further comprising a plurality of switches on an inner wall of each of the grooves, wherein the switches form the movable short-circuit surfaces when conducting a current, and the movable short-circuit surface controlling mechanisms change positions of the movable short-circuit surfaces by allowing predetermined switches out of the plurality of switches to conduct a current.

5. The array antenna device according to claim 1, wherein an interval between adjacent grooves out of the groove is within a half of a wavelength of an operation frequency along a tube axis direction of the waveguide.

6. The array antenna device according to claim 1, further comprising:

a phase shifter for changing a phase of an input signal; and an amplifier for amplifying the input signal the phase of which has been changed by the phase shifter and outputting the amplified input signal to the waveguide.

7. An array antenna device, comprising a plurality of the array antenna devices according to claim 6 arrayed such that tube axis directions of the waveguides thereof are parallel to each other.

8. The array antenna device according to claim 1, wherein each movable short-circuit surface controlling mechanism in the movable short-circuit surface controlling mechanisms is disposed within one of the plurality of grooves in the waveguide.

9. An array antenna device, comprising:

a waveguide having a plurality of radiation units arranged on one tube wall thereof, wherein the waveguide has a plurality of grooves arranged on an inner side of a tube wall facing the tube wall, movable short-circuit surfaces each electrically short-circuited to an inner wall of one of the grooves, and movable short-circuit surface controlling mechanisms for changing positions of the movable short-circuit surfaces within the plurality of grooves in the waveguide, the waveguide further comprises a plurality of switches on an inner wall of each of the grooves, the switches form the movable short-circuit surfaces when conducting a current, and the movable short-circuit surface controlling mechanisms change positions of the movable short-circuit surfaces by allowing predetermined switches out of the plurality of switches to conduct a current.

10. The array antenna device according to claim 9, wherein each movable short-circuit surface controlling mechanism in the movable short-circuit surface controlling mechanisms is disposed within one of the plurality of grooves in the waveguide.

* * * * *